US006129011A

United States Patent [19]

Cramer

[11] Patent Number: 6,129,011

[45] Date of Patent: Oct. 10, 2000

[54] CALENDER FOR TREATING BOTH SIDES OF A WEB

[75] Inventor: Dirk Cramer, Duisburg, Germany

[73] Assignee: Voith Sulzer Papiertechnik Patent GmbH, Heidenheim, Germany

[21] Appl. No.: 09/226,198

[22] Filed: Jan. 7, 1999

[30] Foreign Application Priority Data

Jan. 8, 1998 [DE] Germany ..... 198 00 331

[51] Int. Cl.[7] ..... B30B 3/04; D21G 1/00

[52] U.S. Cl. ..... 100/331; 100/162 B; 100/163 A

[58] Field of Search ..... 100/161, 162 R, 100/162 B, 163 R, 163 A, 164–166, 170, 331

[56] References Cited

U.S. PATENT DOCUMENTS

| | | | |
|---|---|---|---|
| 3,016,819 | 1/1962 | Kupka | 100/163 A |
| 4,736,678 | 4/1988 | Stotz | 100/163 A |
| 5,438,920 | 8/1995 | Koivukunnas et al. | 100/163 A |
| 5,662,037 | 9/1997 | Van Haag | 100/163 A |

FOREIGN PATENT DOCUMENTS

| | | |
|---|---|---|
| 0661405 | 7/1995 | European Pat. Off. . |
| 195511145 | 10/1996 | Germany . |
| 9514813 | 6/1995 | WIPO . |

*Primary Examiner*—Stephen F. Gerrity
*Attorney, Agent, or Firm*—Greenblum & Bernstein P.L.C.

[57] ABSTRACT

A paper calender has a stack of rolls arranged one above the other. They form an upper stack and a lower stack with a common center roll. Additional center rolls are carried on levers that are capable of pivoting about axes fixed with respect to the frame, and are capable of being placed under load by devices applying force. These devices should be designed to be powerful enough to be capable of compensating for more than the total weight of the associated roll and the parts connected to it. As a result of the various possible settings for the line load, the finishing of the paper can be improved. A method is provided for operating a paper calender having an upper stack of rolls and a lower stack of rolls positioned below the upper stack. Each stack is individually capable of being placed under load by upper and lower force generators. The calender also includes a common center roll that is supported on a frame, and remaining center rolls carried on levers capable of pivoting about axes fixed with respect to the frame. The levers are capable of being placed under load by force applying devices to compensate for more than the total weight of the respective roll and the parts connected to it. The method includes exerting force on the upper stack independently of the force exerted on the lower stack, exerting force on each lever independently of the force exerted by the other force applying devices, and setting the load characteristic curves in the upper stack and lower stack differently.

4 Claims, 2 Drawing Sheets

CALENDER FOR TREATING BOTH SIDES OF A WEB

CROSS-REFERENCE TO RELATED APPLICATION

This application is related to German Patent Application No. 198 00 331.5, which was filed on Jan. 8, 1998, the disclosure of which is expressly incorporated herein by reference in its entirety.

BACKGROUND OF THE INVENTION

1. Field of the Invention

The invention relates to a paper calender with a stack of rolls arranged one above the other. The stack of rolls includes of an upper stack and a lower stack that can each individually be placed under load by upper and lower force generators. The stack also has a common center roll that is supported on the calender's frame, and remaining center rolls that are carried on levers capable of pivoting about axes fixed with respect to the frame and that are capable of being placed under load by force applying devices. The invention also relates to a method for operating the calender.

2. Discussion of Background Information

A calender is known from German Patent No. DE 195 11 145 A1. In this calender, a common center roll is a flexible, adjustable roll with a cover (casing, jacket or shell) lift having a cover supported on a carrier that passes through the cover and is fixed with respect to the frame. The cover is also supported by an upper support apparatus that can be compressively loaded and a lower support apparatus so that it can be compressively loaded. The paper web is fed such that one side of it in the upper stack and the other side of it in the lower stack comes into contact with hard rolls that are responsible for the smoothness of the paper. With the aid of a force applying device the weight of associated parts can be compensated for. As a result of the roll weight, the load characteristic curves have a negative slope in both the upper stack and the lower stack, i.e. the line loads increase from top to bottom from gap to gap.

Known from International Patent Publication No. WO 95/14813 is a paper calender with a roll stack in which all center rolls located between an upper and a lower end roll are carried on levers. These levers can be placed under load by devices that apply force. The devices are designed to be powerful enough to be capable of compensating for more than the total weight of the roll and the parts connected to it. In this way, load characteristic curves with positive slope can be achieved as well as those with negative slope.

However, in both cases it is difficult to give the paper web approximately the same surface consistency on both sides.

SUMMARY OF THE INVENTION

Hence an object of the invention is to improve the finishing of the paper web. This object is achieved with a paper calender of the type initially described in that the devices applying force are designed to be powerful enough to be capable of compensating for more than the total weight of the roll and the parts connected to it.

According to the present invention, the load characteristic curve can be modified in two ways. First, the characteristic curves of the upper stack and lower stack can be set independently and, in particular, offset with respect to one another. Second, the slope of the characteristic curves in the upper stack and lower stack can be selected individually over a large range, even including positive slope. In particular, in this setting, it can be taken into account that a paper web that has run through the upper stack has a prior history with regard to a number of characteristics such as density, smoothness, gloss, temperature and possibly also moisture, which requires individual adjustment of the characteristic curve in the lower stack.

It is desirable for the force exerted by the upper and lower force generators to be capable of being set independently of one another. It is also desired that the force exerted by the force applying devices are capable of being set independently of one another. It is also advantageous for the force applying devices to be able to act bidirectionally, i.e. to be able not only to relieve the load but also to apply it, thus offering even more adjustment options.

A method for the operation of such a calender is characterized in that the load characteristic curves in the upper stack and lower stacks are set differently. The settings depend on the specific paper and the desired characteristics.

Advantageously, the characteristic curves have different slopes, particularly opposing slopes. It is further advantageous for the characteristic curves to be offset relative to one another. A further advantageous embodiment provides for the characteristic curves to contain sections having differing slopes.

According to one embodiment, the rolls comprise hard rolls and soft rolls. Furthermore, working gaps exist between adjacent rolls. Each working gap is delimited by one hard roll and one soft roll. Also, a change gap exists between two soft center rolls. The change gap is between the upper stack and the lower stack. Preferably, at least one of the hard rolls is heatable.

The paper calender may also include an upper end roll in the upper stack and a lower end roll in the lower stack. The upper end roll and lower end roll are flexibly adjustable and have roll covers supported by a plurality of support elements.

A method of operating the paper calender may include the upper force generator pressing an upper end roll downwardly while a lower end roll is held rigidly with respect to the frame. The method may also include the lower force generator pressing a lower end roll upwardly while an upper end roll is held rigidly with respect to the frame. The method of operating the paper calender may also include the upper force generator pressing an upper end roll downwardly, and the lower force generator pressing a lower end roll upwardly while the common center roll is held rigidly with respect to the frame.

According to one embodiment, a method of operating the paper calender is provided wherein the force applying devices apply pressure to the levers according to zones to ensure that a uniform compression exists over the length of the rolls.

According to a further embodiment, a method of operating the paper calender is provided including altering each line load of each working gap as a function of an amount and direction of pressure applied to the adjacent lever.

A method is provided for operating a paper calender having an upper stack of rolls and a lower stack of rolls positioned below the upper stack. Each stack is individually capable of being placed under load by upper and lower force generators. The calender also includes a common center roll that is supported on a frame, and remaining center rolls carried on levers capable of pivoting about axes fixed with respect to the frame. The levers are capable of being placed under load by force applying devices to compensate for more than the total weight of the respective roll and the parts connected to it. The method includes exerting force on the upper stack independently of the force exerted on the lower stack, exerting force on each lever independently of the force exerted by the other force applying devices, and setting the load characteristic curves in the upper stack and lower stack differently.

BRIEF DESCRIPTION OF THE DRAWING

The invention is explained in greater detail below with reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
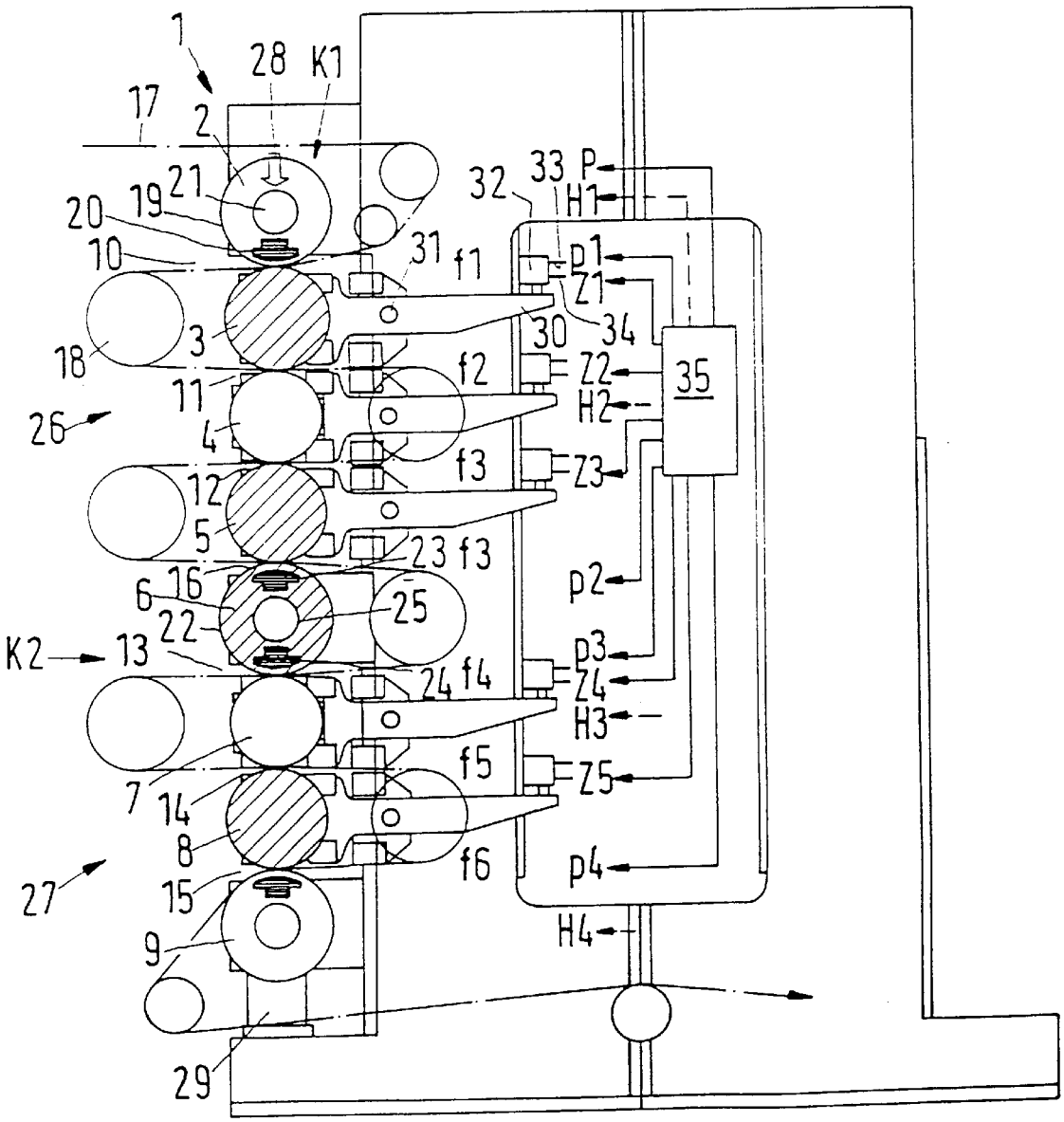
FIG. 1 shows a view of a calender in accordance with the invention.

The calender illustrated in FIG. 1 has a roll stack 1 that consists of eight rolls 2 through 9, namely a heatable, hard, upper end roll 2 with controllable deflection, a soft center roll 3, a heatable hard center roll 4, a soft center roll 5, a soft center roll 6 with controllable deflection, a heatable, hard center roll 7, a soft center roll 8 and a heatable, hard, lower end roll 9 with controllable deflection. In this way, the result is six working gaps 10 through 15, which are each delimited by one hard roll and one soft roll, and in their center a change gap 16, which is delimited by two soft rolls 5 and 6.

A paper web 17 is supplied from a paper machine, and under the control of guide rolls 18, passes through the working gaps 10 through 12, the change gap 16 and the working gaps 13 through 15, whereupon it is wound in a winding device. In the three upper working gaps 10 through 12, one side of the paper web is in contact with the center rolls, and in the three lower working gaps 13 through 15 the other side is in contact with the center rolls, so that the desired surface structure, for example gloss or smoothness, is achieved.

The upper end roll 2 and the lower end roll 9 are designed as flexibly adjustable rolls in which the roll covers 19 are supported by a series of support elements 20 on a nonrotatable carrier 21. The center roll 6 is likewise designed as a flexibly adjustable roll. The cover 22 of the center roll 6 is supported by an upper support device 23 that is formed by a series of support elements, and a lower support device 24 that is formed by a series of support elements, on a nonrotatable carrier 25 that is fixed relative to the frame. The center roll 6 is adjustable as a whole relative to the carrier 25. Such flexibly adjustable rolls are known, for example in the form of NIPCO rolls. The support elements can be replaced by other known support devices.

Due to the presence of the center roll 6 supported on the frame, an upper stack 26 and a lower stack 27 result that have the center roll 6 in common, and which can each work with their own load characteristic curve. Upper force generators K1 apply force to the upper stack 26. The force generators K1 are formed by upper lift cylinder 28 and the support device 23. Lower force generators K2 apply force to the lower stack 27. The lower force generators K2 are formed by the support device 24, which presses the lower stack 27 against the lift piston 29 that is kept fixed relative to the frame during operation.

The remaining rolls 3, 4, 5, 7, and 8 are supported with their bearing journals on levers 30 that are pivotable about pivot points 31 fixed relative to the frame. At the lever's free end, a device 32 can pressure every lever by applying force from a pistoncylinder unit, which compensates for the weight of the associated roll and additional parts borne by it, such as the guide roll 18, and thus exerts an influence on the load characteristic curve. These devices 32 are supplied with hydraulic fluid via two supply lines 33 and 34, and can therefore move the levers both upwardly and downwardly.

To separate the rolls of the stack, the carrier of the lower end roll 9 can be lowered by means of the lift cylinder 29. As a result, the center rolls 3, 4, 5, 7, 8 supported on the levers 30 are lowered until the levers come in contact with a stop (not illustrated), while the common center roll 6 lowers until the cover lift is terminated by an internal stop.

One or more of the hard rolls 2, 4, 7, 9 are heatable, as indicated by the arrows H1 through H4. The heat energy can be supplied through induction or any other known product, for example through electric resistance heating, or radiant heating with the aid of a heat transfer medium, and the like.

A control unit 35 coordinates the individual parameters of paper web treatment. Thus, in addition to the heat energy H1 through H4, the force P is determined, with which the upper force generator K1 presses the upper end roll 2 downward while the lower end roll 9 is held rigid with respect to the frame. The loading can also take place in the influenced in accordance with the amount and direction of the pressure. All the aforementioned quantities are predetermined by the control unit 35 and can be adjusted by the control unit independently of the other quantities. The pressure brings about line loads f1 through f6 in the working gaps 10 through 16.

Figure 2:
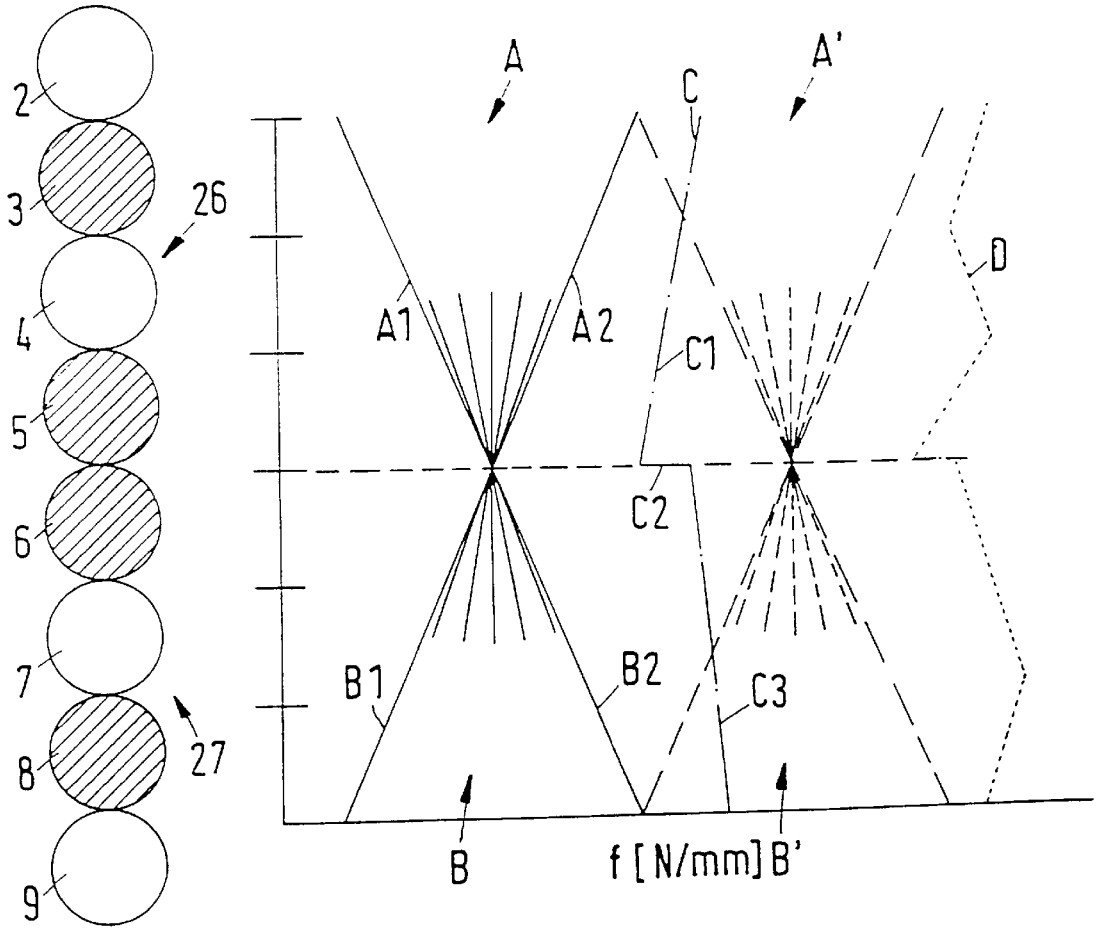
FIG. 2 shows a stack of rolls with associated characteristic curves.

FIG. 2 shows load characteristic curves of the calender, which is to say the line load f as a function of the individual working gaps. A characteristic curve group A for the upper stack 26 shows that the characteristic curve can have a negative slope (A1) or a positive slope (A2) and a host of values in between. In like manner, a characteristic curve group B for the lower stack 27 can have characteristic curves with positive slope (B1) and characteristic curves with negative slope (B2) and a host of characteristic curves in between. Moreover, each individual characteristic curve can be shifted horizontally, as is illustrated with dashed lines A and B. Illustrated by a dot-dash line is one possibility for setting a characteristic curve C, which has from top to bottom, a section C1 with positive slope, a transient section C2, and a section C3 with a relatively small negative slope. Characteristic curves D are even possible, in which sections in the region of the upper stack have slopes that differ from one another, as do the slopes in the region of the lower stack 27. In any case, the individual characteristic curves can be chosen such that optimum treatment of the paper is achieved.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A paper calender comprising:

an upper stack of rolls;

a lower stack of rolls positioned below the upper stack, each of the upper stack and the lower stack being individually capable of being placed under compressive force by upper and lower force generators;

the upper stack having a top roll and a soft center roll with at least one hard center roll and at least one soft center roll disposed therebetween;

the lower stack having a bottom roll, at least one hard center roll and at least one soft center roll;

a common center roll, located between the soft center roll of the upper stack and a center roll of the lower stack, that is supported on a frame;

each of the hard and soft center rolls in each of the upper and lower stacks being carried on levers capable of pivoting about axes fixed with respect to the frame;

each lever being pivotally moveable by a force applying device supplied with hydraulic fluid via first and second supply lines, the first supply line supplying pressure to move the lever in one direction and the second supply line supplying pressure to move the lever in the opposite direction;

the upper stack having at least two nips and the lower stack having at least two nips, wherein the at least two nips of the upper stack exert a compressive force on a web which is different from a compressive force exerted by the at least two nips of the lower stack, wherein the levers are moveable by force applying devices which apply a force to compensate for more than the total weight of the respective roll and the parts connected to it, and wherein the force exerted by each force applying device is independent of the force exerted by the other force applying devices.

2. The paper calender of claim 1, wherein the force exerted by the upper force generator is independent of the force exerted by the lower force generator.

3. The paper calender of claim 1, wherein at least one of the hard center rolls of one of the upper stack and the lower stack is heatable.

4. The paper calender of claim 1, wherein the top roll of the upper stack and the bottom roll of the lower stack are each flexibly adjustable and having roll covers supported by a plurality of support elements.

* * * * *